US007299815B2

(12) United States Patent
Yamanishi

(10) Patent No.: US 7,299,815 B2
(45) Date of Patent: Nov. 27, 2007

(54) MICROPUMP CHECK VALVE DEVICE AND METHOD OF MANUFACTURING THE SAME

(75) Inventor: Toshihiro Yamanishi, Ehime (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 519 days.

(21) Appl. No.: 10/929,468

(22) Filed: Aug. 31, 2004

(65) Prior Publication Data

US 2005/0053504 A1 Mar. 10, 2005

(30) Foreign Application Priority Data

Sep. 5, 2003 (JP) ..... 2003-313332

(51) Int. Cl.
*F16K 15/14* (2006.01)

(52) U.S. Cl. ..... 137/15.18; 137/512; 137/852; 417/413.2; 417/566

(58) Field of Classification Search ..... 137/15.18, 137/512, 843, 852; 417/413.2, 566
See application file for complete search history.

(56) References Cited

U.S. PATENT DOCUMENTS 5,785,295 A * 7/1998 Tsai ..... 251/11
5,839,467 A * 11/1998 Saaski et al. ..... 137/501
6,749,407 B2 * 6/2004 Xie et al. ..... 417/413.2
2005/0158188 A1 * 7/2005 Matsui et al. ..... 417/410.1

FOREIGN PATENT DOCUMENTS

| | | |
|---|---|---|
| JP | 2-308988 | 12/1990 |
| JP | 4-63973 | 2/1992 |
| JP | 04-290679 | 10/1992 |
| JP | 2000-154783 | 6/2000 |
| JP | 2001-12356 | 1/2001 |
| JP | 2003-133613 | 5/2003 |

* cited by examiner

*Primary Examiner*—Ramesh Krishnamurthy
(74) *Attorney, Agent, or Firm*—Steptoe & Johnson LLP

(57) ABSTRACT

A micropump check valve device which can be designed thin with good assemblability and applied with urging force. The micropump check valve device includes an upstream side member having a small-bore hole for passing therethrough a fluid, a downstream side member having a large-bore hole for passing therethrough the fluid, and a valve member having a valve mechanism sandwiched between the upstream side member and the downstream side member. The valve mechanism includes a passing hole formed in correspondence to a position and a size of the large-bore hole in the downstream side member, a contacting part formed inside the passing hole in correspondence to the position and size of the small-bore hole in the upstream side member thereby to close the small-bore hole, and supporting parts formed to bridge across the passing hole to support the contacting part. The valve member has a greater linear expansion coefficient than the upstream side and downstream side members.

8 Claims, 15 Drawing Sheets

MICROPUMP CHECK VALVE DEVICE AND METHOD OF MANUFACTURING THE SAME

BACKGROUND OF THE INVENTION

1. Field of the Invention

The present invention relates to a micropump that is a small apparatus for supplying small amounts of a fluid and is used in medical equipment, a chemical analyzer, a microreactor, a biochemical chip or the like, and in particular relates to a check valve device for such a micropump that carries out flow rate control to high accuracy in the case of any of a liquid, a gas or a gas/liquid mixture.

2. Description of the Related Art

Conventionally, as art relating to micropumps that deliver small amounts of liquids, many mechanistic principles have been proposed based on ultra-microfabrication technology called nanotechnology or MEMS (microelectromechanical systems). Such micropumps are used as apparatuses for supplying small amounts of fluids in medical equipment or chemical analyzers, being used for quantitative injection of drugs or for transporting fluids such as mixed reaction gases. The development of small general-purpose micropumps for which highly accurate control is possible is currently still being proceeded with. In general, check valves are often used in micropumps. Under constraints on smallness and thinness, the valve mechanism of such a check valve is required to have springiness (pre-load) so as to make it such that the valve does not open unless the pressure exceeds a certain value. Hereinafter, this springiness is referred to as 'urging force'.

FIG. 15 is an example of a sectional view showing a conventional micropump. As shown in FIG. 15, such a micropump is often manufactured by laminating together a plurality of plates as described below. FIGS. 16A is a perspective view showing members relating to a check valve device in particular. First, a first valve plate 2, which is a second member, having therein a small-bore inflow hole 2*a* and a valve mechanism 10B is placed on a first fixing plate 1, which is a first member, having therein a small-bore inflow hole 1*a* and a large-bore outflow hole 1*b* for allowing passage of a fluid. A central plate 3, which is a third member, having therein a small-bore inflow hole 3*a* and a small-bore outflow hole 3*b* is then placed thereon. A second valve plate 4, which is a fourth member, having therein a valve mechanism 10A and a small-bore outflow hole 4*b* is then placed on the central plate 3, and a second fixing plate 5, which is a fifth member, having therein a large-bore inflow hole 5*a* and a small-bore outflow hole 5*b* is then placed thereon. A diaphragm 7 having a piezoelectric element 8 installed thereon is joined to the second fixing plate 5 via pressure chamber vertical walls 9. The space enclosed by the second fixing plate 5, the pressure chamber vertical walls 9 and the diaphragm 7 shall be referred to as the pressure chamber 6.

Here, the inflow hole 1*a* in the first fixing plate 1, the inflow hole 2*a* in the first valve plate 2, the inflow hole 3*a* in the central plate 3, a large-bore hole 13B provided in the valve mechanism 10A in the second valve plate 4, and the inflow hole 5*a* in the second fixing plate 5 communicate with one another, thus forming an inflow side flow path through which the fluid is introduced into the pressure chamber 6. Moreover, a pressure chamber 6 communicates with the outflow hole 5*b* in the second fixing plate 5 and the outflow hole 4*b* in the second valve plate 4, and the outflow hole 4*b* in the second valve plate 4 communicates with the outflow hole 3*b* in the central plate 3, a large-bore hole 13B provided in the valve mechanism 10B in the first valve plate 2, and the outflow hole 1*b* in the first fixing plate 1, thus forming an outflow side flow path through which the fluid is discharged from the pressure chamber 6. According to this constitution, a micropump having a flow path from the inflow hole 1*a* of the first fixing plate 1, through the valve mechanism 10A of the second valve plate 4, through the pressure chamber 6, through the valve mechanism 10B of the first valve plate 2, and up to the outflow hole 1*b* of the first fixing plate 1, and check valve devices due to the valve mechanisms 10A and 10B can be manufactured. Note that the first fixing plate 1 and the second fixing plate 5 have the same shape as one another, but with the face attached to the central plate 3 being reversed. Moreover, as with the fixing plates 1 and 5, the first valve plate 2 and the second valve plate 4 also have the same structure as one another, with only the face attached to the central plate 3 being different.

In the micropump, the valve mechanisms 10A and 10B are disposed in two locations, i.e. in the inflow side flow path and in the outflow side flow path. Here, the valve mechanism in the inflow side flow path is 10A, and the valve mechanism in the outflow side flow path is 10B. The valve mechanisms 10A and 10B are each composed of the large-bore passing hole 13A or 13B which is formed in correspondence to a position and a size of the large-bore hole (the inflow hole 5*a* or the outflow hole 1*b*) in the member (the second fixing plate 5 or the first fixing plate 1) on the downstream side of the valve mechanism 10A or 10B relative to the direction of flow of the fluid, a contacting part 11A or 11B for closing the small-bore hole (the inflow hole 3*a* or the outflow hole 3*b*) in the central plate 3, the contacting part being formed to face the position of and to have a size corresponding to that of the small-bore hole, and supporting parts 12A or 12B that are formed to bridge across the passing hole 13A or 13B so as to support the contacting part 11A or 11B from both sides. The contacting part 11A or 11B is formed inside this passing hole 13A or 13B to face the position of and to have a size corresponding to the size of the small-bore hole (the inflow hole 3*a* or the outflow hole 3*b*) in the central plate 3, which is the member on the upstream side of the valve mechanism 10A or 10B relative to the direction of flow of the fluid. Note that in the following, unless specifically stated otherwise, 'contacting part 11' and 'supporting parts 12' shall refer to either the contacting part 11A and the supporting parts 12A or the contacting part 11B and the supporting parts 12A. Similarly, 'valve mechanism 10' shall refer to either the valve mechanism 10A or the valve mechanism 10B. Moreover, regarding the definition of terminology, the case of a single valve in the valve plate 2 or 4 shall be referred to as 'valve mechanism', and the valve mechanism system in which are combined the valve plate 2 or 4 containing the valve mechanism 10, and the first fixing plate 1 and the central plate 3, or the central plate 3 and the second fixing plate 5, that sandwich the valve plate 2 or 4 from either side shall be referred to as 'check valve device'.

Regarding the urging force of each valve mechanism 10, as with the valve mechanism 10A shown in FIG. 16A, a method using a spacer 15 is usual, but various other inventions have also been disclosed. For example, as shown enlarged in FIG. 16B, there are an invention in which a projecting part 16 is formed from a resin on the contacting part 11B through post-processing (see, for example, Japanese Patent Application Laid-open No. 4-63973 (page 2; page 3, FIG. 1(*d*))), and an invention in which such a projecting part 16 is formed at the same time as manufacturing the first valve plate 2 having the contacting part 11B therein (see, for example, Japanese Patent Application Laid-open No. 2-308988 (page 2; page 4, FIG. 3)). Furthermore, although not shown in the drawings, there is also an invention in which the contacting part 11 is not planar but rather is formed as a hemispherical projecting part (see, for example, Japanese Patent Application Laid-open No. 2001-12356 (page 2; page 6, FIG. 2)).

Note that as the materials of the members constituting the check valve devices, metallic silicon is often used for each of the valve plates 2 and 4 having supporting parts 12 and a contacting part 11, and glass is often used for the central plate 3 and the fixing plates 1 and 5.

Next, a description of the liquid delivery principle of the micropump and the urging force of each of the check valve devices will be given with reference to FIGS. 17 and 18. FIG. 18A shows a state in which the micropump is at a standstill. As shown in FIG. 18B, when the piezoelectric element 8 deforms upward, the inside of the pressure chamber 6 instantaneously becomes at a negative pressure, and hence a pressure difference arises between in front of and behind the valve mechanism 10A; the contacting part 11A of the valve mechanism 10A thus moves upward, whereby a gap is produced, and hence fluid flows into the pressure chamber 6. Upon the fluid flowing into the pressure chamber 6, the negative pressure is relieved, whereby the pressure difference between in front of and behind the valve mechanism 10A gradually disappears, and hence the load opening the contacting part 11A disappears. At this time, because the valve mechanism 10A is provided with an urging force (springiness) as shown in FIG. 17, upon the pressure difference dropping as described above, the contacting part 11A of the valve mechanism 10A is brought into contact with the central plate 3 by the urging force, whereby the flow path can be closed.

FIG. 18C shows a phenomenon in which the piezoelectric element 8 deforms downward and thus pushes the fluid out from the pressure chamber 6, showing a situation in which the pressure increases due to the piezoelectric element 8 pushing the fluid in the pressure chamber 6, and hence a pressure difference arises between in front of and behind the valve mechanism 10B of the first valve plate 2, and thus the valve mechanism 10B opens. Again, in this case, upon the fluid being discharged from the pressure chamber 6 to some extent, the pressure difference between in front of and behind the valve mechanism 10B disappears, and hence the contacting part 11B is brought into contact with the contacting part 11 due to the urging force possessed by the valve mechanism 10B, whereby the flow path can be closed. As the liquid delivery principle of the micropump, liquid is thus delivered by repeating movement from the state shown in FIG. 18A, through the state shown in FIG. 18B and the state shown in FIG. 18C, and back to the state shown in FIG. 18A, at a frequency of from several tens of Hz to several hundred Hz.

Each valve mechanism 10 thus separates away from the central plate 3 to create a flow path only when required, thus controlling the flowing in and out of the fluid. Moreover, in general, a function of the valve mechanism 10 being brought into contact with the central plate 3 through a certain urging force to close the flow path is required. As described above, as prior art for bestowing such an urging force, the technical method of an invention in which a spacer 15 is inserted between the valve mechanism 10 and the central plate 3, or the technical method of an invention in which a projecting part 16 is formed integrally is usual.

However, with the conventional constitution described above, in the case that a spacer 15 is installed, the various plates must be laminated and fixed together in a state in which the axial center of the spacer 15 and the axial center of each of the contacting part 11 of the valve mechanism 10 and the inflow hole 3*a* or the outflow hole 3*b* of the central plate 3 are aligned, and advanced assembly technology is required for this operation. Moreover, the size of a micropump used in medical equipment or a chemical analyzer is approximately a flat shape of dimensions 1 cm×1 cm with a thickness of 1.0 to 1.5 mm, and hence the volume allocated to the spacer 15 is only a diameter of 100 to 200 μm by a thickness of several tens of μm, and thus handling during the assembly process, and manufacture of the spacer 15 are not easy. Moreover, there are many factors impeding making the micropump thin, for example, despite being thin, the spacer 15 still has a thickness of several tens of μm, and hence space is required for accommodating the spacer 15, and moreover there is also the thickness of the adhesive layer in the case of fixing the spacer 15 to the central plate 3 (or the valve plate 2 or 4) using an adhesive.

In the case that a projecting part 16 is formed on the contacting part 11B of the valve mechanism 10B as shown in FIG. 16B, again as in the case of the spacer 15, the projecting part 16 is thin, and hence there is a problem that the assemblability including handling is poor. Furthermore, despite being thin, the thickness of the projecting part 16 cannot be ignored from the viewpoint of the micropump, and hence there are many factors impeding making the micropump thin.

SUMMARY OF THE INVENTION

The present invention resolves the above problems of the prior art, and has an object to provide a micropump check valve device which is capable of receiving an urging force and can be designed to be thin while having good assemblability, and to provide a method of manufacturing such a micropump check valve device.

A micropump check valve device according to a first aspect of the present invention for resolving the above problems of the prior art is a micropump check valve device provided in a flow path through which a fluid is passed from an upstream side to a downstream side through pressure change in a micropump. The micropump check valve device comprises an upstream side member having formed therein a small-bore hole through which the fluid is passed, a downstream side member having formed therein a large-bore hole through which the fluid is passed, and a valve member having a valve mechanism formed therein and sandwiched between the upstream side member and the downstream side member, wherein the valve mechanism of the valve member is composed of a passing hole that is formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting parts, the supporting parts being formed in such a manner as to bridge across the passing hole, and wherein the valve member has a greater linear expansion coefficient than the upstream side member and the downstream side member.

A micropump check valve device according to a second aspect of the present invention is the micropump check valve device according to the first aspect, wherein each of the supporting parts of the valve mechanism has a recess formed on a downstream side surface thereof.

A micropump check valve device according to a third aspect of the present invention is the micropump check valve device according to the first aspect, wherein each of the supporting parts of the valve mechanism has a projection on an upstream side surface thereof.

A micropump check valve device according to a fourth aspect of the present invention is the micropump check valve device according to the first aspect, wherein the linear expansion coefficient of the valve member is at least 1.4 times greater than the linear expansion coefficient of at least one of the upstream side member and the downstream side member.

Further, methods of manufacturing a micropump check valve device according to fifth to eighth aspects of the present invention are methods of manufacturing the micropump check valve devices according to the first to fourth aspects respectively, wherein the upstream side member, the valve member and the downstream side member are fixed together under an environment at a temperature higher than room temperature, for example using a process such as ultrasonic welding, thermal caulking, diffusion bonding, or bonding using a thermosetting adhesive.

Furthermore, a micropump check valve device according to a ninth aspect of the present invention is a micropump check valve device provided in a flow path through which a fluid is passed from an upstream side to a downstream side through pressure change in a micropump. The micropump check valve device comprises an upstream side member having formed therein a small-bore hole through which the fluid is passed, a downstream side member having formed therein a large-bore hole through which the fluid is passed, and a valve member having a valve mechanism formed therein in a sandwiched manner between the upstream side member and the downstream side member, wherein the valve mechanism of the valve member is composed of a passing hole that is formed in correspondence to a position and a size of the large-bore hole in the downstream side member, a contacting part for closing the small-bore hole in the upstream side member, the contacting parts formed inside the passing hole in such a manner as to correspond to the position and size of the small-bore hole in the upstream side member, and supporting parts for supporting the contacting part, the supporting parts being formed in such a manner as to bridge across the passing hole, and wherein the valve member itself is supported by the supporting parts in such a manner that the contacting part of the valve member projects toward the upstream side.

According to the micropump check valve devices and the methods of manufacturing the same of the present invention, the valve mechanism can be given an urging force without using a spacer or a projecting part provided as a separate member, and hence the ability to design the micropump to be thin and the assemblability can be improved.

DESCRIPTION OF THE PREFERRED EMBODIMENTS

Following is a detailed description of micropump check valve devices according to embodiments of the present invention with reference to the drawings.

First Embodiment

First, a micropump using a micropump check valve device according to a first embodiment of the present invention will be described with reference to FIGS. 1 to 12.

Figure 1A:
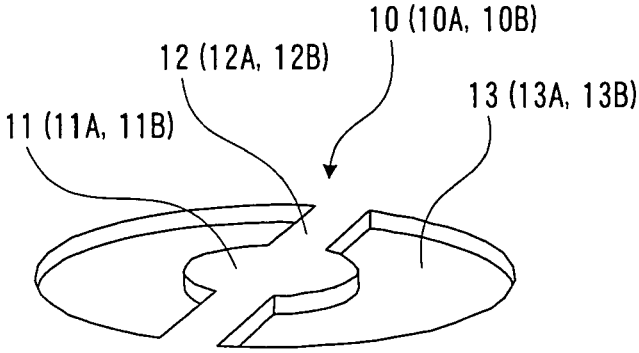
FIGS. 1A and 1B show a micropump check valve device according to a first embodiment of the present invention, FIG. 1A being a perspective view showing in particular a valve mechanism thereof enlarged and FIG. 1B being an exploded perspective view of the micropump check valve device.
Figure 1B:
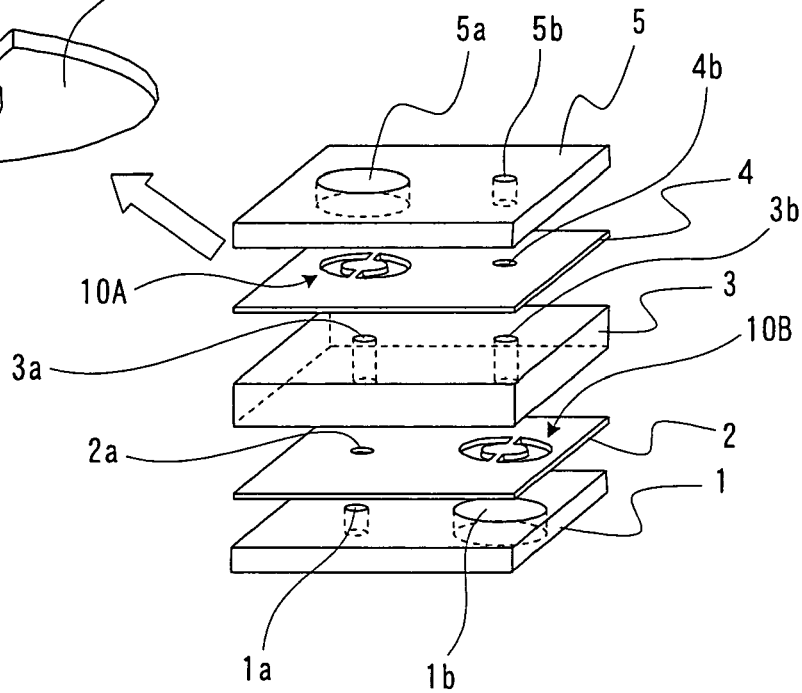
Figure 2:
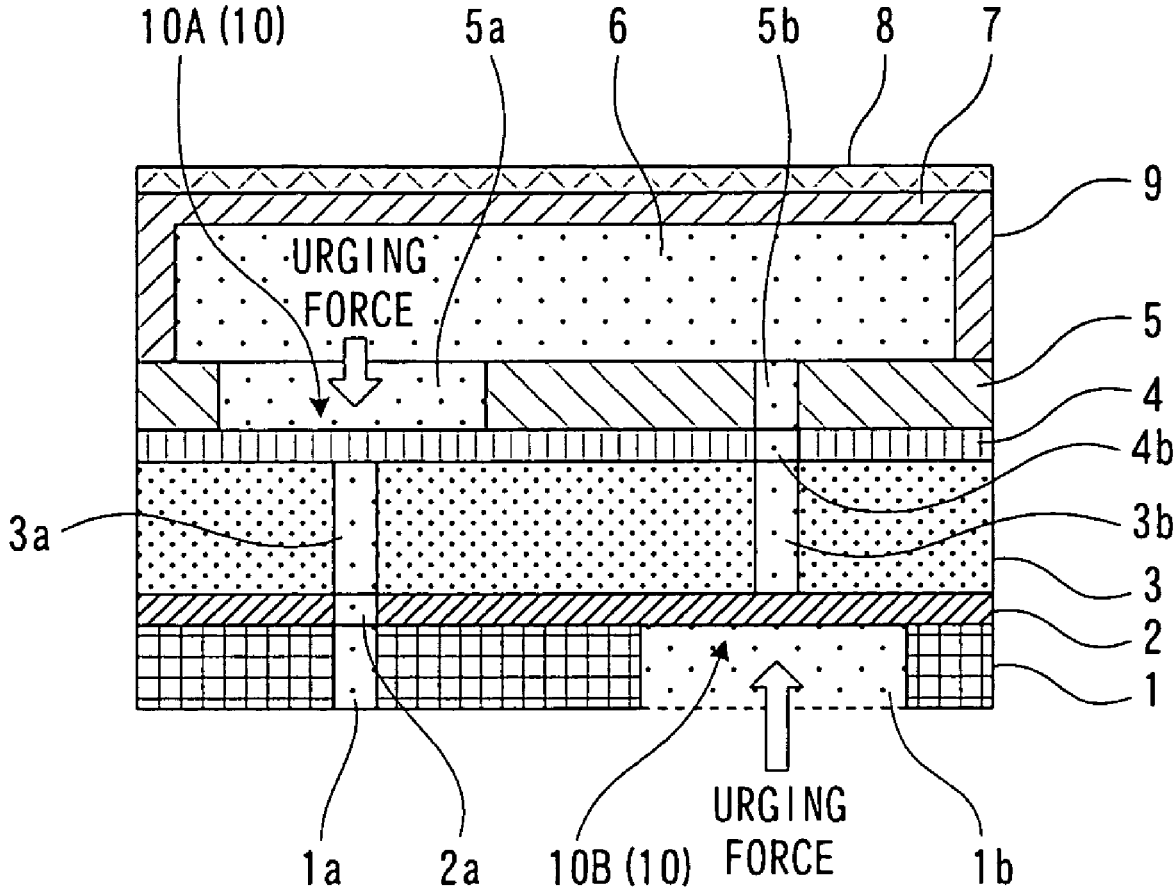
FIG. 2 is a sectional view of a micropump using two of the above micropump check valve devices, and shows the direction of the urging force possessed by each valve mechanism.

As shown in FIG. 1B and FIG. 2, the micropump comprises a first fixing plate 1, which is a first member, having therein a small-bore inflow hole 1*a* and a large-bore outflow hole 1*b* for allowing passage of a fluid (a gas, a liquid, or a mixture thereof), a first valve plate 2, which is a second member, having therein a small-bore inflow hole 2*a*, which is disposed so as to be connected to the inflow hole 1*a* in the first fixing plate 1, and a valve mechanism 10B, a central plate 3, which is a third member, having therein a small-bore inflow hole 3*a*, which is disposed so as to be connected to the inflow hole 2*a* in the first valve plate 2, and a small-bore outflow hole 3*b*, which is disposed so as to face the valve mechanism 10B, a second valve plate 4, which is a fourth member, having therein a small-bore outflow hole 4*b*, which is disposed so as to be connected to the outflow hole 3*b* in the central plate 3, and a valve mechanism 10A, a second fixing plate 5, which is a fifth member, having therein a small-bore outflow hole 5*b*, which is disposed so as to be connected to the outflow hole 4*b* in the second valve plate 4, and a large-bore inflow hole 5*a*, which is disposed so as to face the valve mechanism 10A, a pressure chamber 6 into which flows fluid that has passed through the inflow hole 5*a* in the second fixing plate 5, a diaphragm 7 that vibrates and thus applies pressure to the pressure chamber 6, and a piezoelectric element 8 that makes the diaphragm 7 vibrate.

As shown in FIGS. 1A and 1B, each valve mechanism 10 (10A or 10B) is composed of the large-bore passing hole 13A or 13B, which is formed in correspondence to a position and a size of the large-bore hole (the inflow hole 5*a* or the outflow hole 1*b*) in the member (the second fixing plate 5 or the first fixing plate 1) on the downstream side of the valve mechanism 10A or 10B relative to the direction of flow of the fluid, a contacting part 11A or 11B that is formed inside (in a central portion of) this passing hole 13A or 13B such as to face the position of and to have a size corresponding to the size of the small-bore hole (the inflow hole 3*a* or the outflow hole 3*b*) in the central plate 3, which is the member on the upstream side of the valve mechanism 10A or 10B relative to the direction of flow of the fluid, and is for closing the small-bore hole (the inflow hole 3*a* or the outflow hole 3*b*) in the central plate 3, and supporting parts 12A or 12B that are formed such as to bridge across the passing hole 13A or 13B, and support the contacting part 11A or 11B from both sides.

Moreover, in particular, in the present invention, for the first valve plate 2 and the second valve plate 4, a material having a larger linear expansion coefficient than that of each of the first fixing plate 1, the central plate 3 and the second fixing plate 5 is selected.

Here, the first valve plate 2 and the second valve plate 4 are ultimately used in a state fixed to the first fixing plate 1, the central plate 3 and the second fixing plate 5. As the fixing method, ultrasonic welding, diffusion bonding, thermal caulking, thermal welding, a thermosetting adhesive, or the like can be used, and in any of these cases the fixing is carried out under a high-temperature environment of approximately 400 to 800° C., before returning to a room temperature environment (approximately 10 to 30° C.).

According to the above constitution, in the manufacturing process, when the valve plates 2 and 4 are returned to room temperature after being fixed to the first fixing plate 1, the second fixing plate 5 and the central plate 3 under a high-temperature environment, the valve plates 2 and 4 are subjected to compressive stress. The reason for this is that the valve plates 2 and 4 try to contract more than the first fixing plate 1, the second fixing plate 5 and the central plate 3 by an amount corresponding to the difference in linear expansion coefficient, and hence compressive stress arises.

Figure 3A:
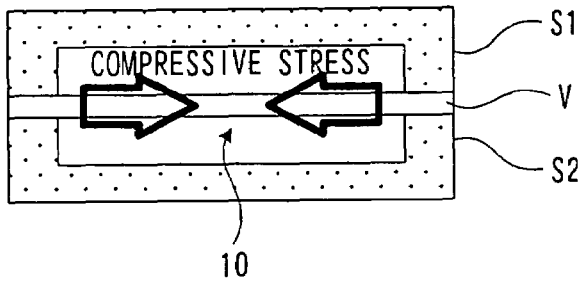
FIGS. 3A to 3C are sectional views for conceptually explaining an urging force generating mechanism, FIG. 3A showing compressive stress acting on a valve plate, FIG. 3B showing a state in which the valve plate has buckled upward due to the compressive stress, and FIG. 3C showing a state in which the valve plate has buckled downward due to the compressive stress.
Figure 3B:
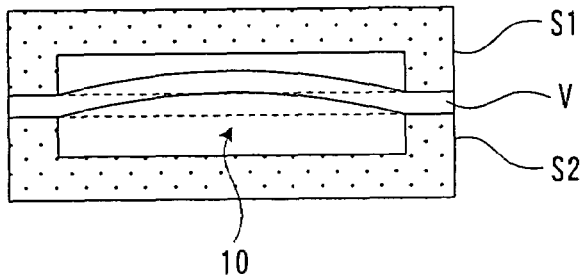
Figure 3C:
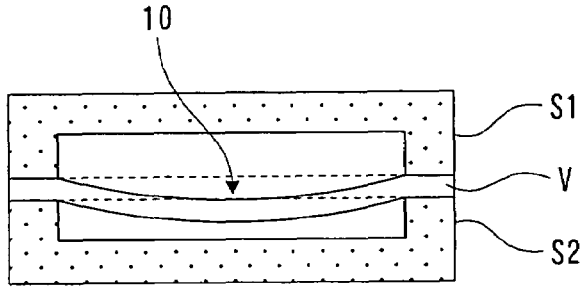

Here, FIGS. 3A to 3C show a model of the behavior upon fixing a valve plate V that is to have a valve mechanism 10 therein under a high-temperature environment to fixing plates S1 and S2 that have the same shape as each other and a linear expansion coefficient lower than that of the valve plate V, and then returning to room temperature. When the temperature drops, because the valve plate V has a larger linear expansion coefficient than the fixing plates S1 and S2, the valve plate V tries to contract more than the fixing plates S1 and S2 by an amount corresponding to the difference in linear expansion coefficient, and hence compressive stress arises, causing a buckling phenomenon. In the case that the fixing plates S1 and S2 fixed to the top and bottom of the valve plate V have the same shape as each other, the probabilities of the direction of the buckling being upward as shown in FIG. 3B and being downward as shown in FIG. 3C are the same.

Figure 4:
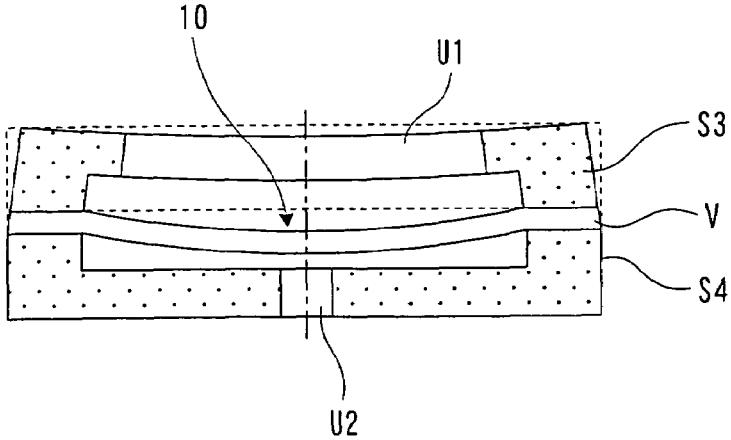
FIG. 4 is a sectional view for conceptually explaining an urging force generating mechanism, showing that upper and lower fixing plates have, in centers thereof, holes of different sizes respectively, and the valve plate buckles downward upon returning to room temperature after carrying out fixing under a high-temperature environment.
Figure 5A:
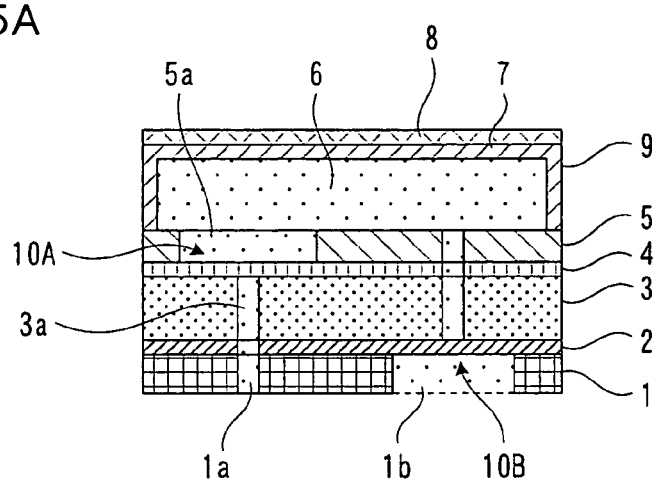
FIGS. 5A to 5C are sectional views of the micropump check valve device for explaining the liquid delivery principle of a micropump having the micropump check valve device, FIG. 5A showing a state where the micropump is at a standstill and a contacting part of each valve mechanism is in contact with a central plate, FIG. 5B showing a state where a piezoelectric element deforms upward and hence a fluid is sucked into a pressure chamber, and FIG. 5C showing a state where the piezoelectric element deforms downward and hence the fluid is discharged from the pressure chamber.
Figure 5B:
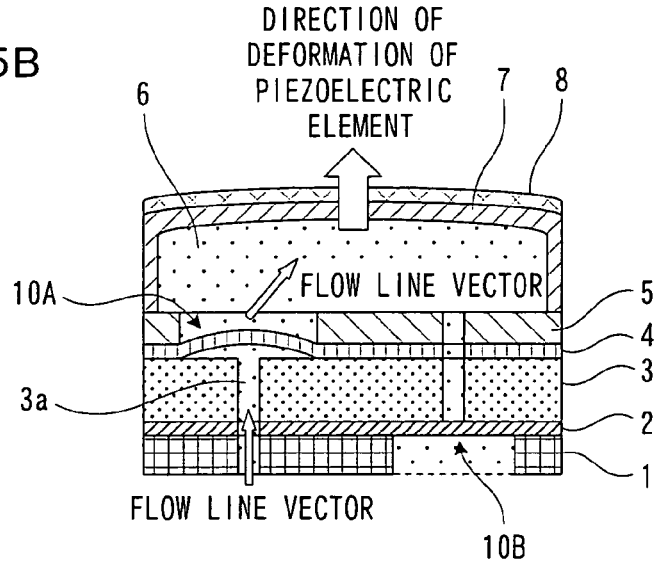
Figure 5C:
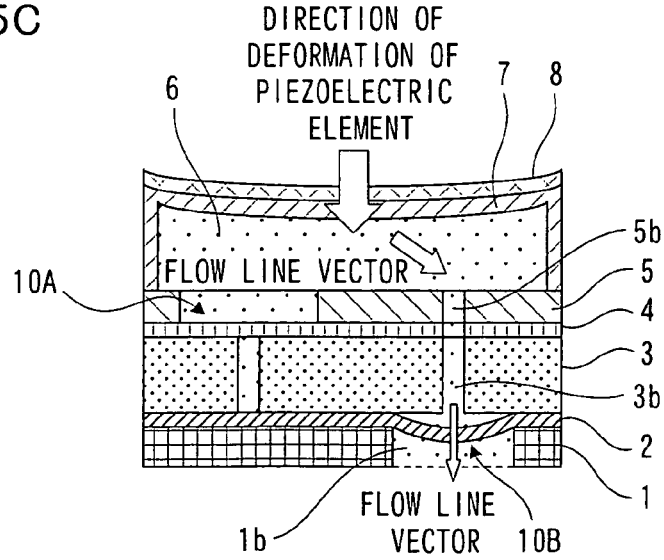
Figure 6A:
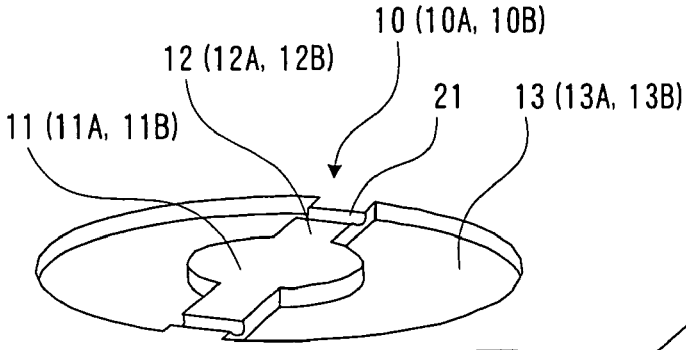
FIGS. 6A and 6B show a variation of the micropump check valve device according to the first embodiment of the present invention, FIG. 6A being an enlarged perspective view showing in particular a valve mechanism of the micropump check valve device, and FIG. 6B being an exploded perspective view of the micropump check valve device.
Figure 6B:
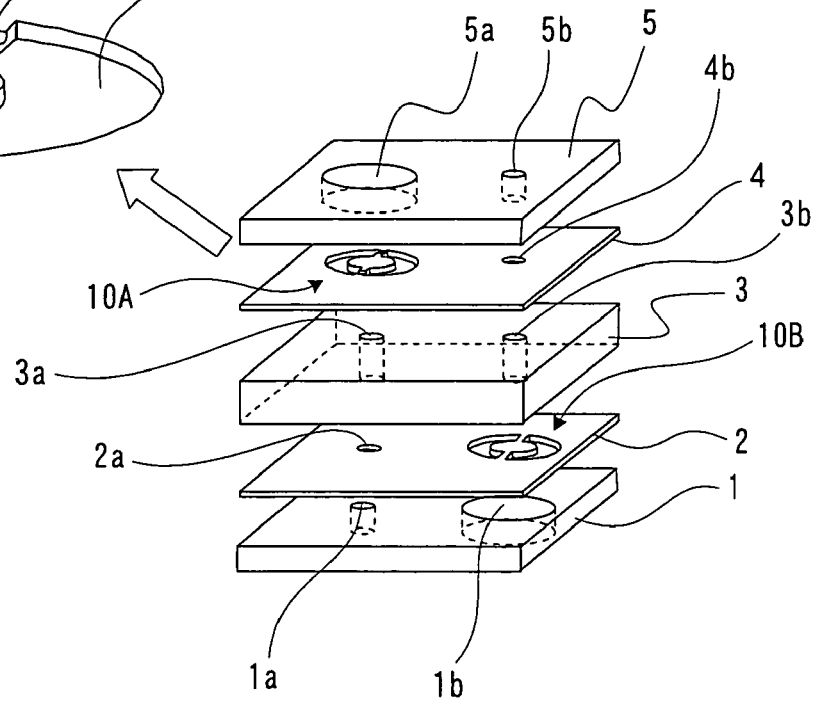
Figure 7:
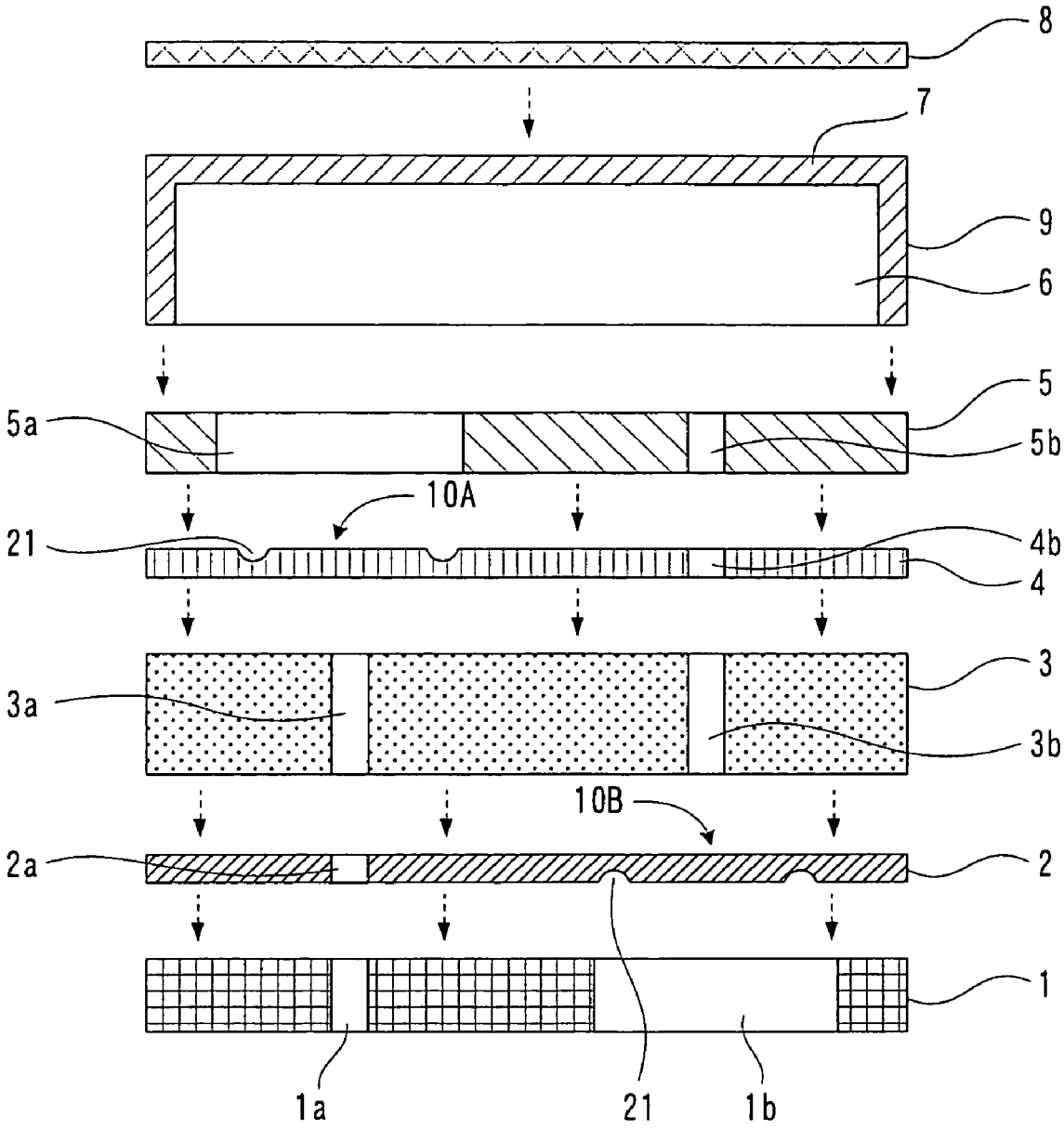
FIG. 7 is a sectional view showing how to assemble a micropump using the micropump check valve device shown in FIG. 6.

FIG. 4 shows the state of deformation upon fixing a valve plate V to fixing plates S3 and S4 under a high-temperature environment, and then returning to room temperature, in the case that the fixing plates S3 and S4 have respectively in the centers thereof holes U1 and U2 of different sizes, with the hole U1 in the fixing plate S3 being larger than the hole U2 in the fixing plate S4. In this case, the upper fixing plate S3 has the larger hole U1 therein, and hence has lower mechanical rigidity than the lower fixing plate S4; the fixing plate S3 thus collapses inward, and due to the effect thereof the valve plate V buckles downward. The structure shown in FIG. 4 is of a similar form to that around each valve mechanism 10 as shown in FIGS. 2 and 5A, and hence a similar effect also arises with each valve mechanism 10. That is, with the micropump check valve devices shown in FIGS. 2 and 5A, again the linear expansion coefficient of the first valve plate 2 and the second valve plate 4 is greater than that of the first fixing plate 1, the second fixing plate 5 and the central plate 3, and hence the supporting parts 12 and the contacting part 11 of each valve mechanism 10 try to buckle toward the central plate 3 side, and thus as shown in FIG. 2, there is an effect of the contacting part 11 of each valve mechanism 10 pushing against the wall around the inflow hole 3*a* or the outflow hole 3*b* of the central plate 3. This effect is equivalent to giving each valve mechanism 10 an urging force.

As a result, despite the structure being very simple, each valve mechanism 10 can be given an urging force, and hence in a state in which the micropump is at a standstill, the inflow hole 3*a* and the outflow hole 3*b* of the central plate 3 can be well closed up by a prescribed pressure by the contacting part 11 of the respective valve mechanism 10, and moreover it is not necessary to use a spacer 15 or to provide a projecting part 16 on the contacting part 11 of each valve mechanism 10 as conventionally, and hence the micropump can be made thin well.

Next, FIGS. 6 to 9 show a variation of the micropump check valve device; with this micropump check valve device, in addition to the constitution of the micropump check valve device of the embodiment described above, as shown enlarged in FIG. 6A, recesses 21 are provided in the supporting parts 12 (12A or 12B) of each valve mechanism 10 (10A or 10B) in a surface on the opposite side to the surface of the contacting part 11 (11A or 11B) that contacts during closing of the valve mechanism, i.e. in the surface on the downstream side relative to the direction of flow of the fluid.

Figure 9:
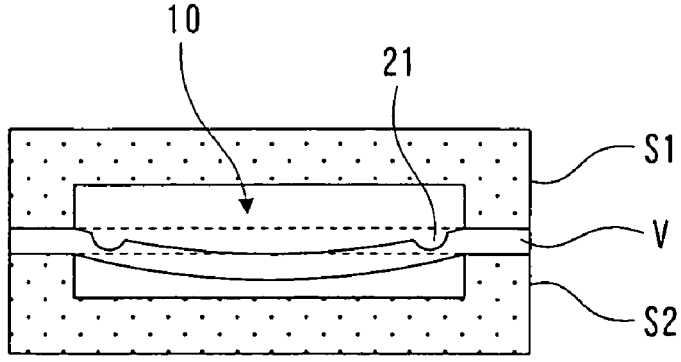
FIG. 9 is a sectional view for conceptually explaining the urging force generating mechanism, showing that recesses are provided in a valve plate and that the valve plate buckles toward its surface not provided with the recesses.

According to this constitution, when the two valve plates 2 and 4 are returned to room temperature after being fixed to the first fixing plate 1, the second fixing plate 5 and the central plate 3 under a high-temperature environment, causing a buckling phenomenon of each of the valve plates 2 and 4, as shown conceptually in FIG. 9 (in FIG. 9, a case is shown in which the valve plate V having the recesses 21 provided therein is fixed from above and below by fixing plates S1 and S2 having the same shape as one another), the balance of the compressive stress is lost due to the recesses 21 in the supporting parts 12, and hence buckling occurs toward the opposite side to the surface having the recesses 21 therein; compared with the case that there are no recesses 21 in the supporting parts 12, the effect of buckling occurring in a direction such that the contacting part 11 pushes against the central plate 3 is increased.

Figure 8:
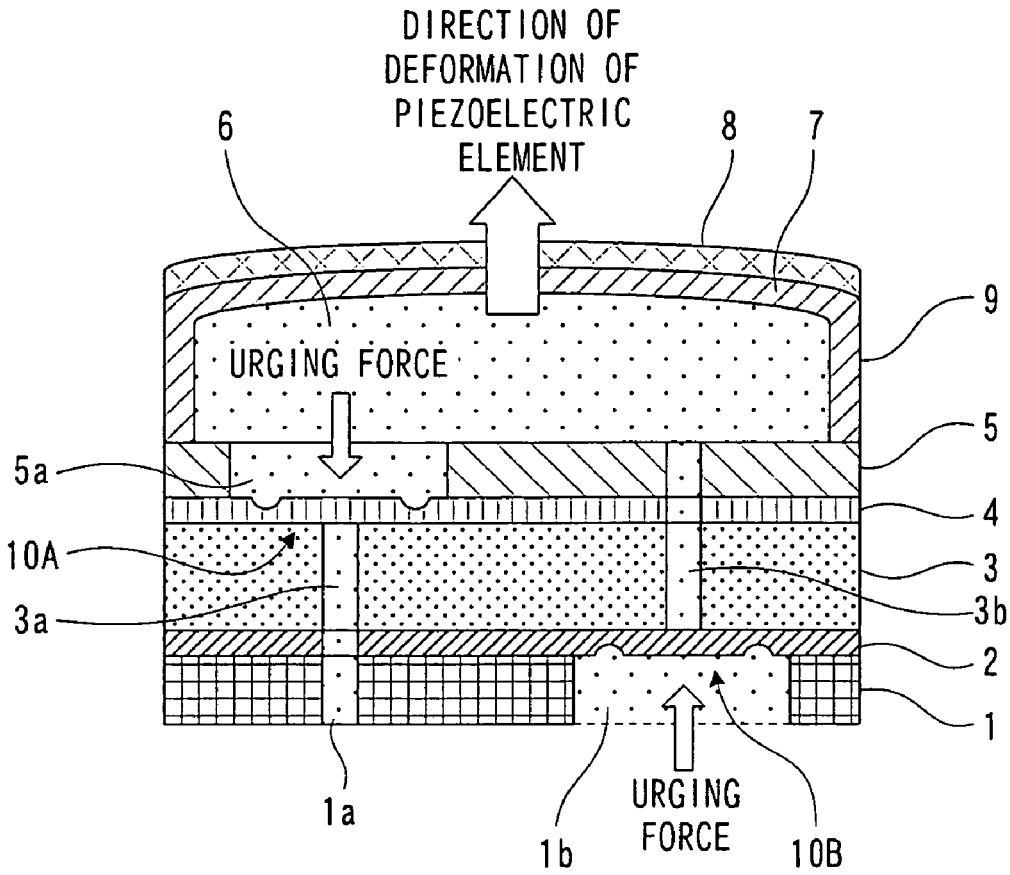
FIG. 8 is a sectional view of the micropump check valve device shown in FIG. 6, indicating the direction of an urging force possessed by the valve mechanism.

As a result, as shown in FIG. 8, in the state in which the valve plates 2 and 4, which have a greater linear expansion coefficient than the first fixing plate 1, the second fixing plate 5 and the central plate 3, have been returned to room temperature after having been fixed to the first fixing plate 1, the second fixing plate 5 and the central plate 3 in a high-temperature state, there is a good effect of the contacting part 11 of each valve mechanism 10 trying to buckle toward the central plate 3 side, and hence the contacting part 11 of each valve mechanism 10 pushing against the wall around the inflow hole 3*a* or the outflow hole 3*b* of the central plate 3. Moreover, because the urging force is bestowed by providing recesses 21 in the supporting parts 12 of each of the valve plates 2 and 4, the valve plates 2 and 4 are not thick, and hence there is an effect of it being possible to design the micropump to be thinner.

Figure 10:
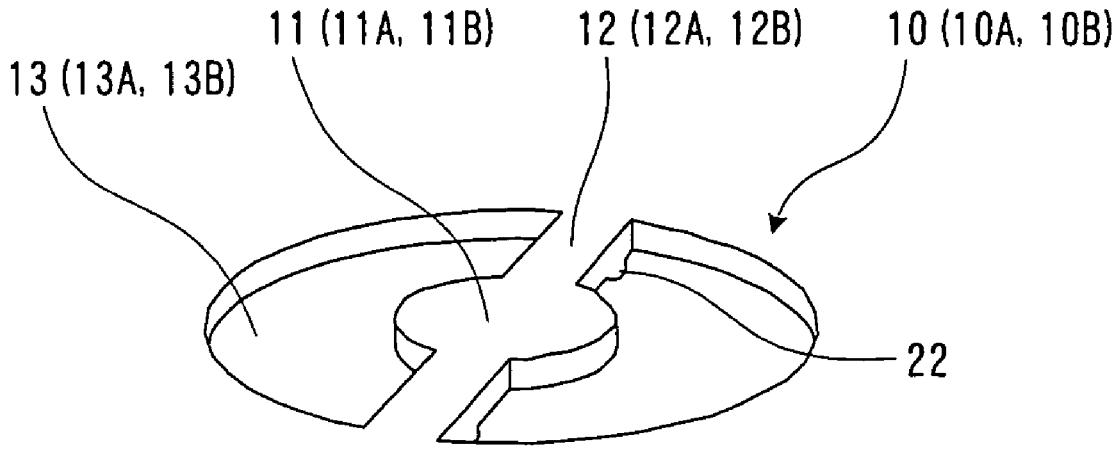
FIG. 10 is an enlarged perspective view of a valve mechanism, showing another variation of the micropump check valve device according to the first embodiment of the present invention.
Figure 11:
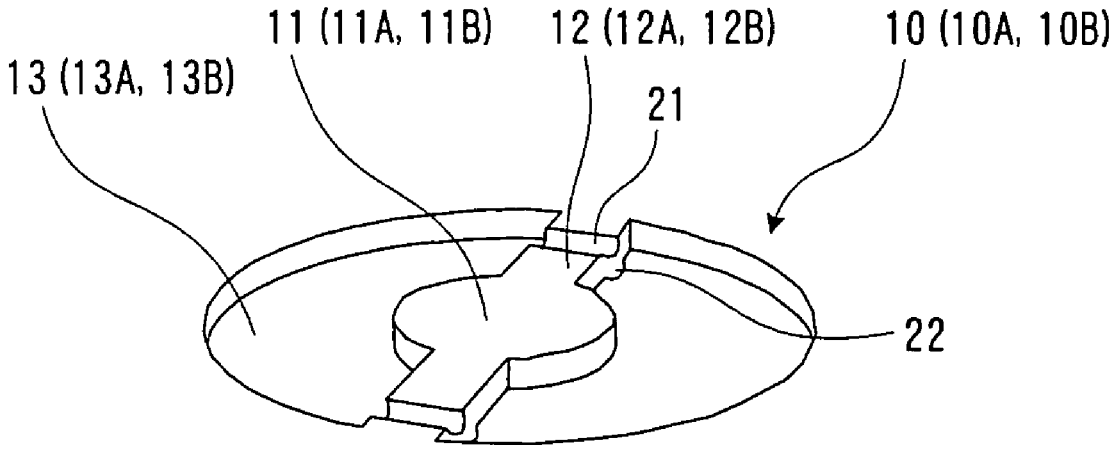
FIG. 11 is an enlarged perspective view showing a valve mechanism, showing yet another variation of the micropump check valve device according to the first embodiment of the present invention.

Moreover, a similar effect is produced if, instead of forming recesses 21 in the surface of the supporting parts 12 on the downstream side, projections 22 are formed on the surface of the supporting parts 12 on the upstream side, i.e. the surface contacting the central plate 3, as shown in FIG. 10; furthermore, it is also possible to form recesses 21 in the surface of the supporting parts 12 on the downstream side and form projections 22 on the surface of the supporting parts 12 on the upstream side as shown in FIG. 11.

As a manufacturing method in this case, by subjecting each of the valve plates 2 and 4 to plastic deformation using a pressing machine or the like, and locally squeezing each of the valve plates 2 and 4, thus forming the recesses 21 and projections 22 simultaneously, manufacture can be carried out in the same number of steps as in the case of forming only recesses 21. By forming recesses 21 and projections 22 on the two surfaces of the valve mechanism 10 in each of the valve plates 2 and 4 in this way, the effect of making the valve mechanism 10 buckle in a direction such as to push against the central plate 3 is strengthened. The performance of the contacting part 11 of each valve mechanism 10 closing up the inflow hole 3*a* or outflow hole 3*b* of the central plate 3 is thus improved.

Note that in the case of this constitution, the projections 22 project out from each of the valve plates 2 and 4, and hence the effect of it being possible to make the micropump thin is lessened. Nevertheless, compared with a valve mechanism having a projecting shape according to prior art that is composed of two members, the processing accuracy is high with there being little variation in the assembly processing, and hence high performance check valves can be provided, and there is also an effect of the total cost being reduced.

Figure 12:
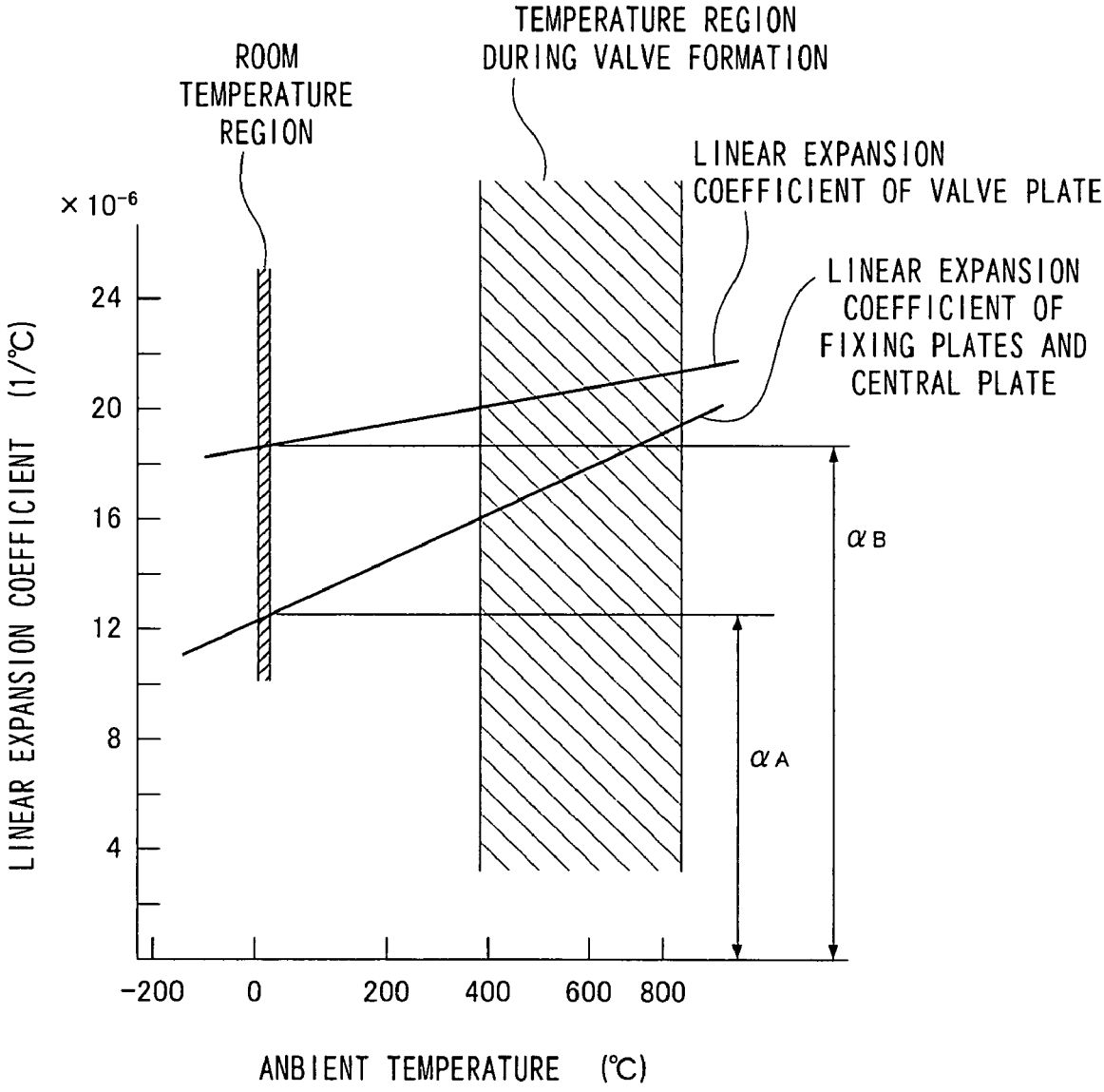
FIG. 12 is a graph showing a change of linear expansion coefficients of materials with temperature, and a temperature region during assembly of the check valve device.

The linear expansion coefficients of the materials constituting the micropump are temperature-dependent as shown in FIG. 12, but there is little literature giving linear expansion coefficients at high temperatures. For example, most of the literature shows linear expansion coefficients restricted to around room temperature as shown in Table 1.

TABLE 1

(Linear expansion coefficients of common industrial materials)

| Material | Linear expansion coefficient (20-40° C.) | Material | Linear expansion coefficient (20-40° C.) |
|---|---|---|---|
| Zinc | $3.97 \times 10^{-5}$ | Pure iron | $1.17 \times 10^{-5}$ |
| Lead | $2.93 \times 10^{-5}$ | Mild steel | $1.12 \times 10^{-5}$ |
| Aluminum | $2.39 \times 10^{-5}$ | Hard steel | $1.07 \times 10^{-5}$ |
| Copper | $1.65 \times 10^{-5}$ | Platinum | $0.89 \times 10^{-5}$ |
| Gold | $1.42 \times 10^{-5}$ | Tungsten | $0.43 \times 10^{-5}$ |

Reference: 'Zairyo Rikigaku' (Mechanics of Materials), 5th Edition, p20, written by Masanori Kikuchi, published by Shokabo Consequently, in actual design, the designer postulates linear expansion coefficients under a high-temperature environment based on the linear expansion coefficients in the room temperature region, and thus devises a rough design plan. What one must be careful about here is that one can envisage cases in which, as shown in FIG. 12, the linear expansion coefficient of the valve plates 2 and 4 is greater than that of the fixing plates 1 and 5 and the central plate 3 at room temperature, and yet the difference between the linear expansion coefficients is reduced at high temperatures. In such a case the desired thermal stress will not be obtained.

It is thus made to be such that the linear expansion coefficient of the valve plates 2 and 4 in the room temperature region is at least 1.4 times that of the fixing plates 1 and 5 and the central plate 3. Table 2 shows the relationship between the linear expansion coefficient ratio and the degree of suitability for check valves. Here, the linear expansion coefficient ratio is the linear expansion coefficient of the valve plates divided by the linear expansion coefficient of the central plate and the fixing plates. The urging force increases proportionately with the linear expansion coefficient ratio, but the degree of freedom to choose the materials drops; a linear expansion coefficient ratio in a range of 1.4 to 1.8 is thus particularly suitable for the valve mechanisms 10.

TABLE 2

(Relationship between linear expansion coefficient ratio and degree of suitability for check valves)

| | Linear expansion coefficient ratio | | | | |
|---|---|---|---|---|---|
| | 1.0 | 1.4 | 1.8 | 2.2 | 3.0 |
| Thermal stress effect | X | ○ | ○ | ◎ | ◎ |
| Degree of freedom to choose materials | ◎ | ◎ | ◎ | ○ | Δ |
| Suitability (overall evaluation) | X | ◎ | ◎ | ○ | ○ |

As specific materials for the valve plates 2 and 4, and the fixing plates 1 and 5 and the central plate 3, for the first embodiment of the present invention, a combination such as (1) aluminum and copper, or (2) aluminum and iron/steel can be used, with the check valves being assembled by thermal welding or a joining method using a thermosetting adhesive. For these combinations, the linear expansion coefficient ratio at room temperature is 1.48 in the case of aluminum and copper, and 2.0 in the case of aluminum and iron/steel.

As described above, in the present first embodiment, by selecting the material of the valve plates 2 and 4 such that the linear expansion coefficient of the valve plates 2 and 4 is greater than that of the central plate 3 and the fixing plates 1 and 5, compressive stress acts on each valve mechanism 10 due to thermal stress arising upon returning to room temperature (10 to 30° C.) after fixing the valve plates 2 and 4 to the central plate 3 and the fixing plates 1 and 5 by welding under a high-temperature environment (e.g. 400 to 800° C.); each valve mechanism 10 buckles toward the central plate 3 due to this compressive stress, whereby an urging force pushing the contacting part 11 supported by each of the valve plates 2 and 4 against the central plate 3 is obtained, with no impediment of the ability to design the micropump to be thin.

Moreover, providing recesses 21 in the supporting parts 12 of each of the valve mechanisms 10 is preferable, since then the buckling of each check valve can be given directionality such that the check valve buckles toward the central plate 3 through the compressive stress due to the thermal stress, with no impediment of the ability to design the micropump to be thin.

Second Embodiment

Figure 13A:
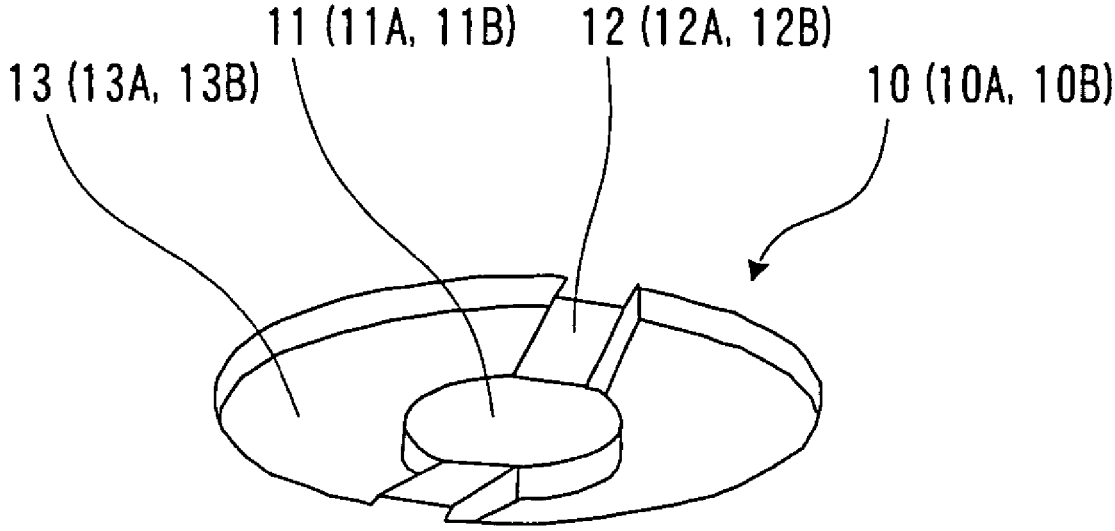
FIGS. 13A and 13B show a micropump check valve device according to a second embodiment of the present invention, FIG. 13A being an enlarged perspective view showing in particular a valve mechanism and FIG. 13B being an enlarged sectional view showing the valve mechanism.
Figure 13B:
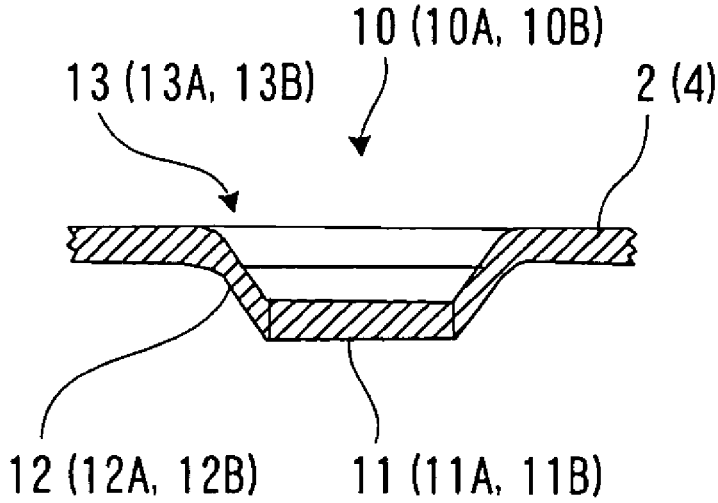
Figure 14:
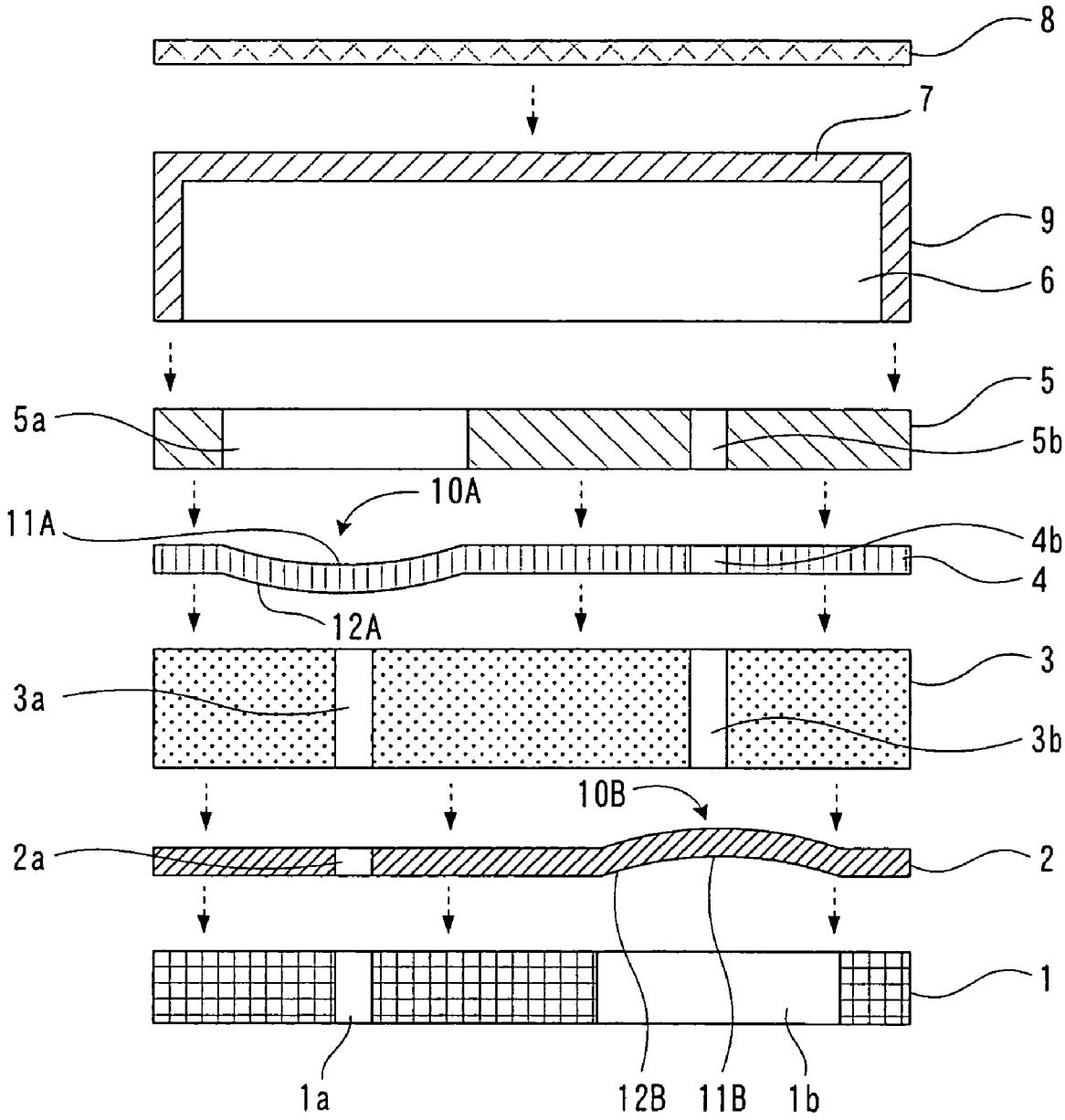
FIG. 14 is a sectional view showing how to assemble a micropump using the micropump check valve device shown in FIG. 13.
Figure 15:
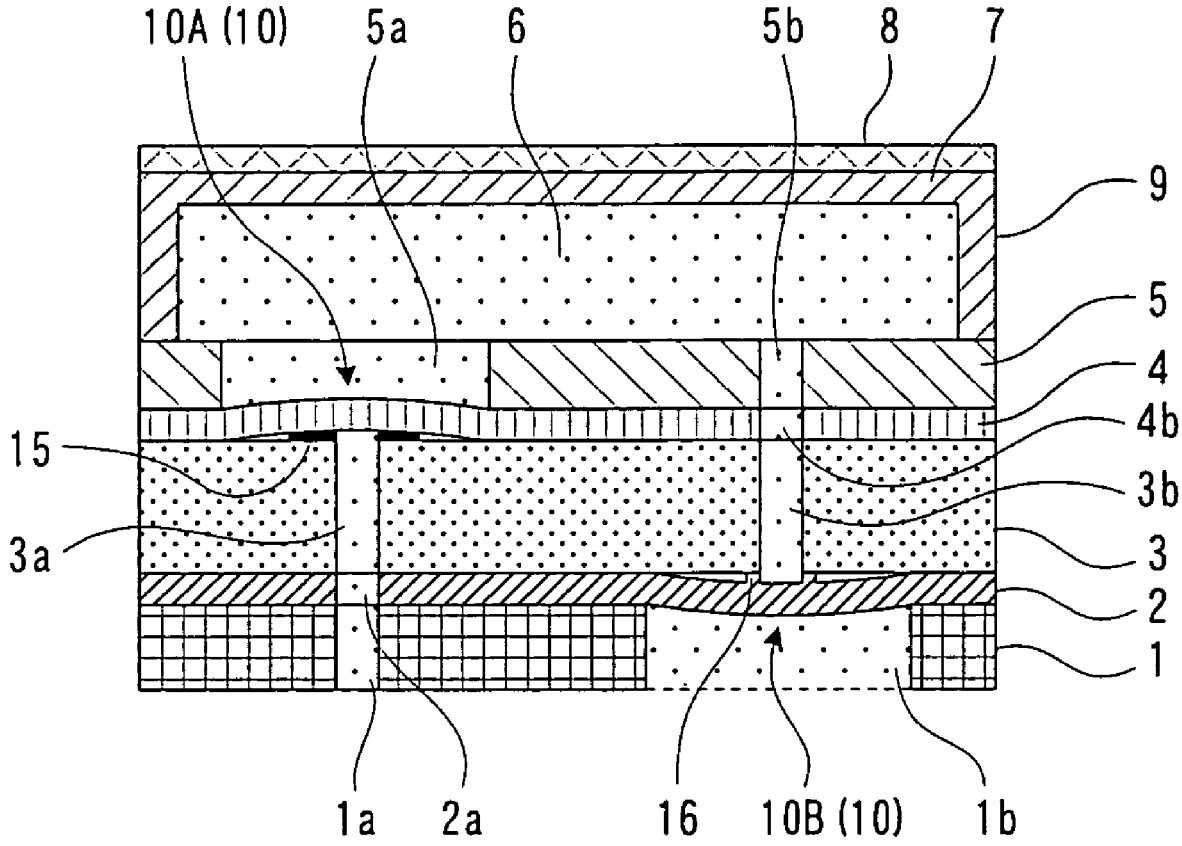
FIG. 15 PRIOR ART
FIG. 15 is a sectional view of a micropump using a conventional micropump check valve device.
Figure 16A:
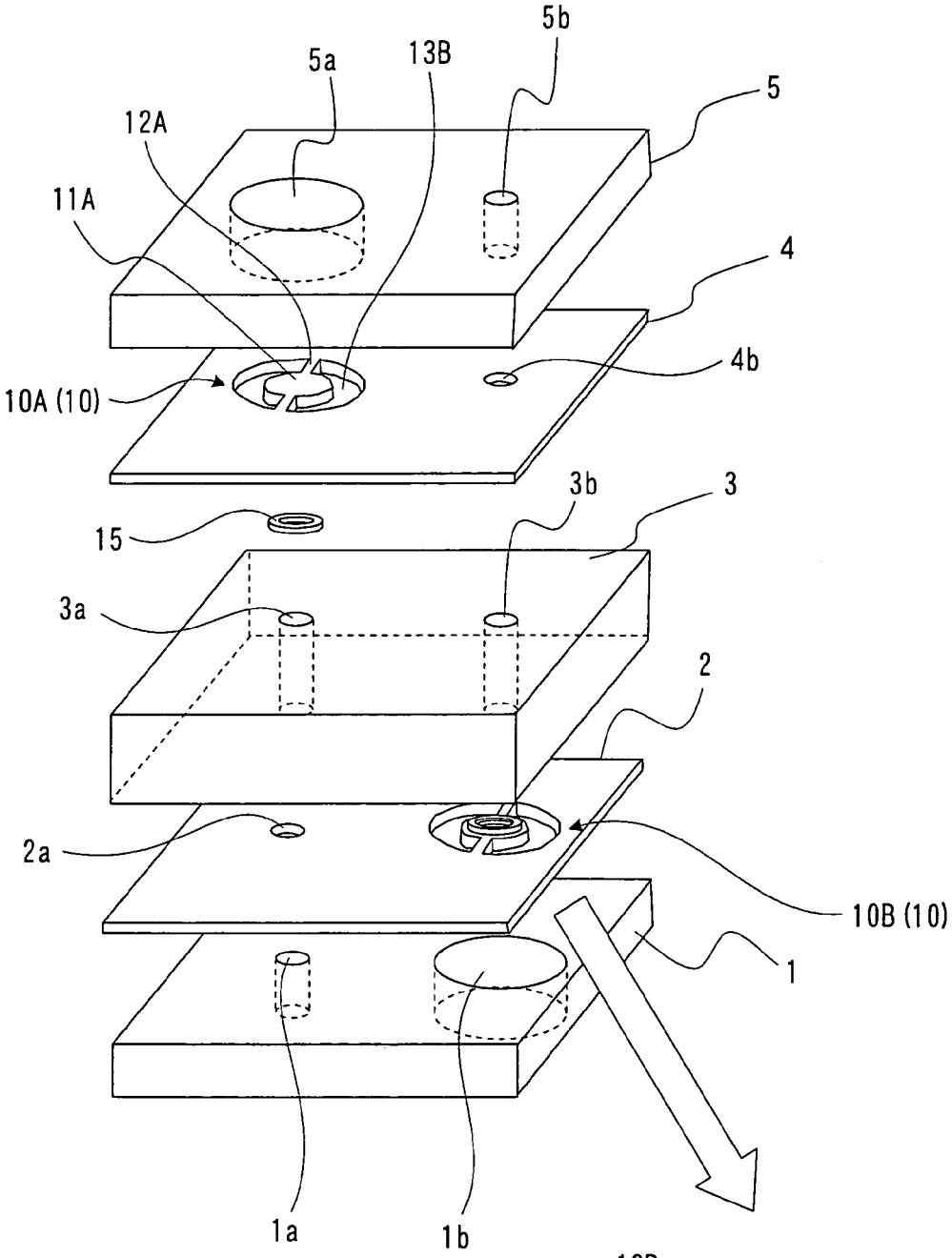
FIG. 16A PRIOR ART
FIGS. 16A and 16B show the conventional micropump check valve device, FIG. 16A being an exploded perspective view of the micropump check valve device and FIG. 16B being an enlarged perspective view of the valve mechanism.
Figure 16B:
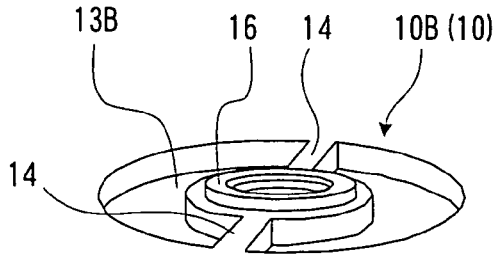
FIG. 16B PRIOR ART
Figure 17:
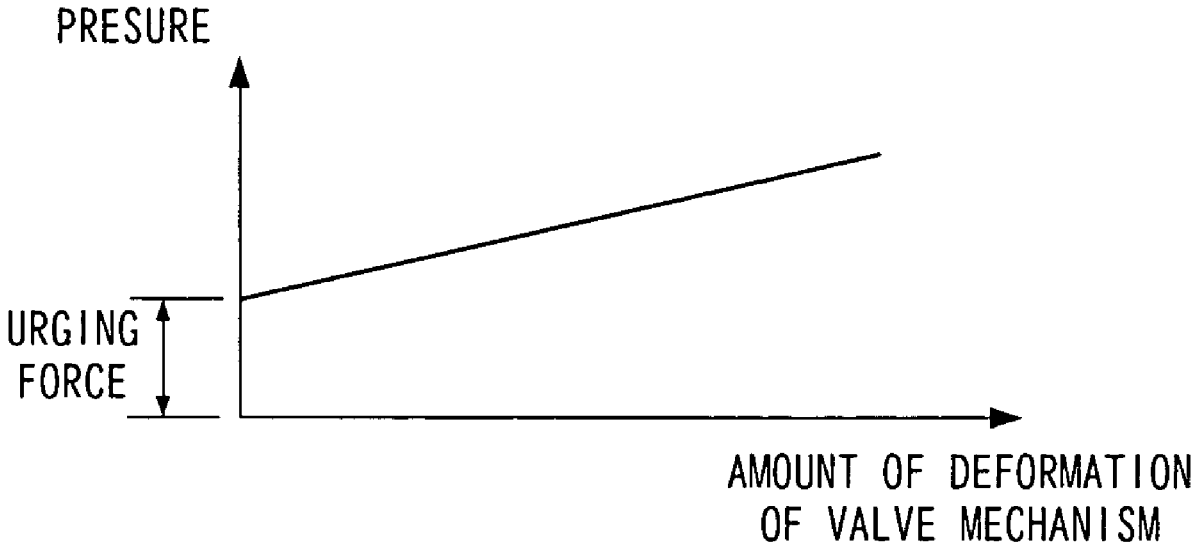
FIG. 17 is a graph showing a relationship between the amount of deformation of a valve mechanism and an urging force in a micropump check valve device.
Figure 18A:
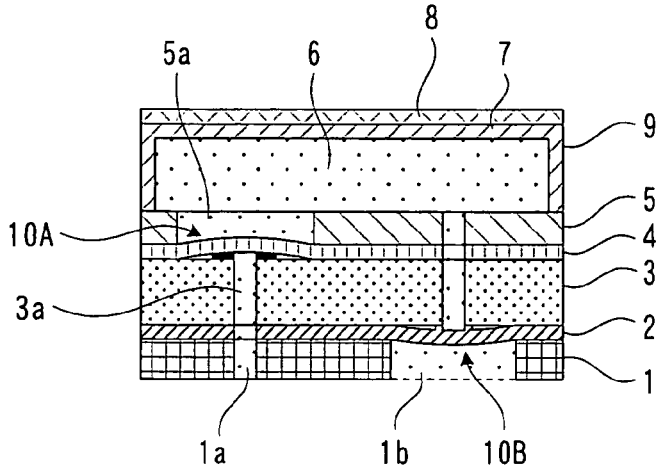
FIG. 18A PRIOR ART
FIGS. 18A to 18C are sectional views of the conventional micropump check valve device for explaining the liquid delivery principle of a micropump having the micropump check valve device, FIG. 18A showing a state where the micropump is at a standstill and a contacting part of each valve mechanism is in contact with a central plate, FIG. 18B showing a state where a piezoelectric element deforms upward and hence a fluid is sucked into a pressure chamber, and FIG. 18C showing a state where the piezoelectric element deforms downward and hence the fluid is discharged from the pressure chamber.
Figure 18B:
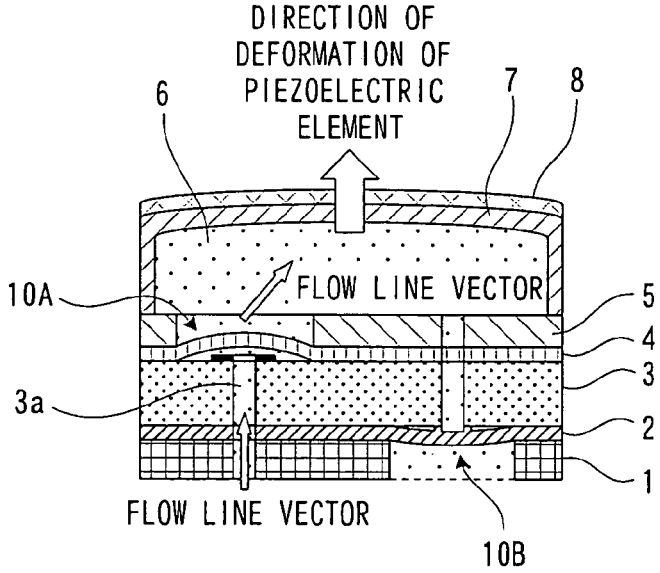
FIG. 18B PRIOR ART
Figure 18C:
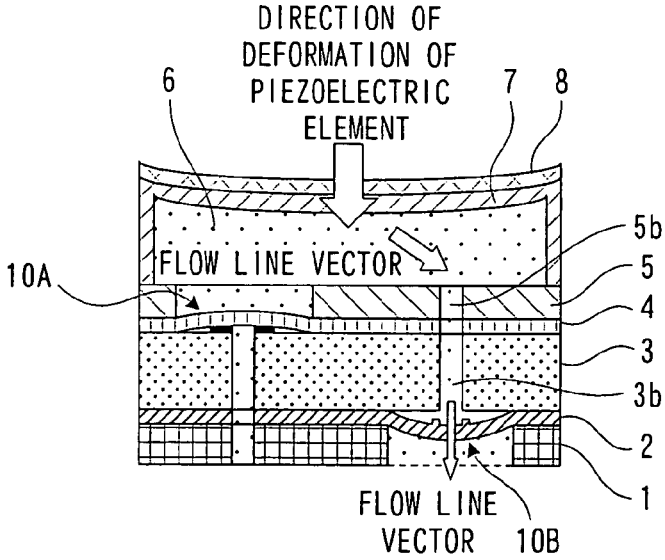
FIG. 18C PRIOR ART

Next, a micropump check valve device according to a second embodiment of the present invention will be described with reference to FIGS. 13 and 14. As shown in FIGS. 13A and 13B, with this micropump check valve device, when manufacturing each valve plate 2 or 4 it self, i.e. when manufacturing the valve member 2 or 4 as a single article, the contacting part 11 (11A or 11B) of the valve mechanism 10 (10A or 10B) is supported by the supporting parts 12 (12A or 12B) in a position projecting out from the valve member 2 or 4 toward the upstream side.

That is, the difference to the constitution of the first embodiment is that thermal stress due to a difference in linear expansion coefficient between the members is not used, and local recesses 21 or projections 22 are not provided in each valve mechanism 10, but rather the whole of each valve mechanism 10 is made to project out in a convex shape toward the central plate 3 in advance, and hence each valve mechanism 10 is made to have an urging force by being forcibly deformed. FIG. 14 shows the manufacturing process schematically; the first valve plate 2 is placed on the first fixing plate 1, and then the central plate 3 is placed thereon. At this time, the fixing is carried out with an orientation such that the contacting part 11B of the valve mechanism 10B in the first valve plate 2 projects toward the central plate 3. Next, the second valve plate 4 is placed on the central plate 3, and again at this time the fixing is carried out such that the contacting part 11A of the valve mechanism 10A in the second valve plate 4 projects toward the central plate 3. After that, the second fixing plate 5, the pressure chamber vertical walls 9, the diaphragm 7, and the piezoelectric element 8 are laminated and fixed on in this order.

According to this constitution, it is not necessary to form (or fix) a separate member onto each valve plate for obtaining the urging force as in the prior art, and hence there is an effect of the check valve assembly operation being easy.

Note that in terms of making the micropump thin, the second embodiment is not as good as the first embodiment since the whole of each valve mechanism 10 projects out. Nevertheless, compared with the case of forming a projecting part as a separate member as in the prior art, each of the valve plates 2 and 4 only needs to have part thereof subjected to additional processing, and hence the projecting part can be made smaller than with the prior art, and thus in terms of making the micropump thin, the second embodiment has an effect intermediate between that of the first embodiment and that of the prior art.

The micropump check valve devices according to the present invention have an effect that the function of an urging force that is required for each valve mechanism can easily be provided, without impeding the ability to design the micropump to be thin; in the case of a small apparatus for supplying small amounts of a fluid used in medical equipment, a chemical analyzer, a microreactor, a biochemical chip or the like, the present invention is useful for an apparatus that carries out flow rate control to high accuracy in the case of any of a liquid, a gas or a gas/liquid mixture.

What is claimed is:

1. A micropump check valve device provided in a flow path through which a fluid is passed from an upstream side to a downstream side through pressure change in a micropump, the micropump check valve device comprising:

an upstream side member having formed therein a small-bore hole through which the fluid is passed;

a downstream side member having formed therein a large-bore hole through which the fluid is passed; and a valve member having a valve mechanism formed therein and sandwiched between the upstream side member and the downstream side member, wherein the valve mechanism of the valve member is composed of a passing hole formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting part, the supporting parts being formed in such a manner as to bridge across the passing hole, and wherein the valve member has a greater linear expansion coefficient than the upstream side member and the downstream side member.

2. The micropump check valve device according to claim 1, wherein each of the supporting parts of the valve mechanism has a recess formed on a downstream side surface thereof.

3. The micropump check valve device according to claim 1, wherein each of the supporting parts of the valve mechanism has a projection on an upstream side surface thereof.

4. The micropump check valve device according to claim 1, wherein the linear expansion coefficient of the valve member is at least 1.4 times greater than the linear expansion coefficient of at least one of the upstream side member and the downstream side member.

5. A method of manufacturing a micropump check valve device, the device comprising an upstream side member having formed therein a small-bore hole through which the fluid is passed, a downstream side member having formed therein a large-bore hole through which the fluid is passed, and a valve member having a valve mechanism formed therein and sandwiched between the upstream side member and the downstream side member, wherein the valve mechanism of the valve member is composed of a passing hole formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting part, the supporting parts being formed in such a manner as to bridge across the passing hole, wherein the valve member has a greater linear expansion coefficient than the upstream side member and the downstream side member, the method comprising:

fixing the upstream side member, the valve member and the downstream side member together under an environment at a temperature higher than room temperature.

6. A method of manufacturing a micropump check valve device, the device comprising an upstream side member having formed therein a small-bore hole through which the fluid is passed, a downstream side member having formed therein a large-bore hole through which the fluid is passed, and a valve member having a valve mechanism formed therein and sandwiched between the upstream side member and the downstream side member, wherein the valve mechanism of the valve member is composed of a passing hole being formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting part, the supporting parts being formed in such a manner as to bridge across the passing hole, wherein the valve member has a greater linear expansion coefficient than the upstream side member and the downstream side member, and wherein each of the supporting parts of the valve mechanism has a recess formed on a downstream side surface thereof, the method comprising:

fixing the upstream side member, the valve member and the downstream side member together under an environment at a temperature higher than room temperature.

7. A method of manufacturing a micropump check valve device, the device comprising an upstream side member having formed therein a small-bore hole through which the fluid is passed, a downstream side member having formed therein a large-bore hole through which the fluid is passed, and a valve member having a valve mechanism formed therein and sandwiched between the upstream side member and the downstream side member, wherein the valve mechanism of the valve member is composed of a passing hole formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting part, the supporting parts being formed in such a manner as to bridge across the passing hole, wherein the valve member has a greater linear expansion coefficient than the upstream side member and the downstream side member, and wherein each of the supporting parts of the valve mechanism has a projection on an upstream side surface thereof, the method comprising:

fixing the upstream side member, the valve member and the downstream side member together under an environment at a temperature higher than room temperature.

8. A method of manufacturing a micropump check valve device, the device comprising an upstream side member having formed therein a small-bore hole through which the fluid is passed, a downstream side member having formed therein a large-bore hole through which the fluid is passed, and a valve member having a valve mechanism formed therein and sandwiched between the upstream side member and the downstream side member, wherein the valve mechanism of the valve member is composed of a passing hole formed in correspondence to a position and a size of the large-bore hole in the downstream side member, a contacting part for closing the small-bore hole in the upstream side member, the contacting part being formed inside the passing hole in such a manner as to correspond to the position and size of the small-bore hole in the upstream side member, and supporting parts for supporting the contacting part, the supporting parts being formed in such a manner as to bridge across the passing hole, wherein the valve member has a greater linear expansion coefficient than the upstream side member and the downstream side member, the linear expansion coefficient of the valve member being at least 1.4 times greater than the linear expansion coefficient of at least one of the upstream side member and the downstream side member, the method comprising:

fixing the upstream side member, the valve member and the downstream side member together under an environment at a temperature higher than room temperature.

* * * * *